US011737576B2

(12) United States Patent
Langegger et al.

(10) Patent No.: US 11,737,576 B2
(45) Date of Patent: Aug. 29, 2023

(54) SLATTED GRATE

(71) Applicant: FLEXINNO GMBH, Saalbach (AT)

(72) Inventors: Josef Langegger, Saalbach (AT); Johannes Langegger, Hinterglemm (AT)

(73) Assignee: FLEXINNO GMBH, Saalbach (AT)

( * ) Notice: Subject to any disclaimer, the term of this patent is extended or adjusted under 35 U.S.C. 154(b) by 318 days.

(21) Appl. No.: 17/154,521

(22) Filed: Jan. 21, 2021

(65) Prior Publication Data

US 2021/0137275 A1 May 13, 2021

Related U.S. Application Data

(63) Continuation of application No. PCT/AT2019/060218, filed on Jul. 2, 2019.

(30) Foreign Application Priority Data

Jul. 24, 2018 (AT) ..... A 50639/2018

(51) Int. Cl.
*A47C 23/06* (2006.01)

(52) U.S. Cl.
CPC ..... *A47C 23/063* (2013.01); *A47C 23/068* (2013.01)

(58) Field of Classification Search
CPC ..... A47C 23/06–23/068
See application file for complete search history.

(56) References Cited

U.S. PATENT DOCUMENTS 17,605 A * 6/1857 Dow ..... A47C 23/063 5/241
54,877 A * 5/1866 Sanborn ..... A47C 23/063 5/241
58,679 A * 10/1866 Falloon ..... A47C 23/063 5/241
71,804 A * 12/1867 Smith ..... A47C 23/063 5/241

(Continued)

FOREIGN PATENT DOCUMENTS

CH 678594 10/1991
CN 201790366 4/2011

(Continued)

OTHER PUBLICATIONS

International Search Report dated Nov. 20, 2019 in International (PCT) Application No. PCT/AT2019/060218.

*Primary Examiner* — Justin C Mikowski
*Assistant Examiner* — Ifeolu A Adeboyejo
(74) *Attorney, Agent, or Firm* — Wenderoth, Lind & Ponack, L.L.P.

(57) ABSTRACT

A slatted grate for reclining or seating furniture, includes a frame for receiving at least two zone elements, in which at least one slat is arranged on the zone elements. The slatted grate further includes an elastic longitudinal bracing member, and the zone elements are connected to one another and/or to a transverse side of the frame by the longitudinal bracing member. A support member is fastened to the frame for mounting the at least two zone elements along a longitudinal extension of the frame, and at least one elastic transverse bracing element is provided. The zone elements are connected to a longitudinal side of the frame by a transverse bracing member.

20 Claims, 5 Drawing Sheets

(56) References Cited

U.S. PATENT DOCUMENTS

| | | | | | |
|---|---|---|---|---|---|
| 95,192 | A * | 9/1869 | Rooks | A47C 23/063 | 5/241 |
| 106,666 | A * | 8/1870 | Cramer | A47C 23/06 | 5/120 |
| 117,976 | A * | 8/1871 | Ambrozy | A47C 23/063 | 5/241 |
| 289,493 | A * | 12/1883 | Bair | A47C 23/063 | 5/241 |
| 731,326 | A * | 6/1903 | Shelton | A47C 23/062 | 5/238 |
| 981,966 | A * | 1/1911 | Brownlee | A47C 23/06 | 5/220 |
| 1,167,692 | A * | 1/1916 | Hinton | A47C 23/06 | 5/220 |
| 1,427,020 | A * | 8/1922 | Bye | A47C 23/06 | 5/305 |
| 4,703,526 | A * | 11/1987 | Degen | A47C 23/064 | 5/237 |
| 4,768,244 | A * | 9/1988 | Riedl | A47C 23/066 | 5/241 |
| 5,280,658 | A * | 1/1994 | Sigl | A47C 23/061 | 5/236.1 |
| 5,924,149 | A * | 7/1999 | Weber | A47C 23/066 | 5/237 |
| 7,621,004 | B2 | 11/2009 | Lobry et al. | | |
| 2003/0196272 | A1* | 10/2003 | Weber | A47C 23/063 | 5/717 |
| 2004/0074008 | A1* | 4/2004 | Martens | A47G 9/109 | 5/636 |
| 2009/0126106 | A1 | 5/2009 | Lobry | | |
| 2009/0183311 | A1* | 7/2009 | Nguyen | A47C 19/021 | 5/174 |
| 2010/0064433 | A1* | 3/2010 | Mora Jimenez | A47C 23/067 | 5/236.1 |
| 2012/0066834 | A1 | 3/2012 | Jansen | | |
| 2012/0167300 | A1* | 7/2012 | Bonac | A47C 23/066 | 5/236.1 |
| 2014/0283306 | A1* | 9/2014 | Gandolfi | A47C 23/064 | 5/659 |

FOREIGN PATENT DOCUMENTS

| | | |
|---|---|---|
| CN | 102341019 | 2/2012 |
| DE | 38 15 098 | 11/1989 |
| DE | 196 34 339 | 2/1998 |
| DE | 299 02 965 | 12/1999 |
| EP | 0 236 292 | 9/1987 |
| EP | 0 428 227 | 5/1991 |
| EP | 0 923 331 | 10/2001 |
| EP | 3 251 557 | 12/2017 |
| ES | 1 061 285 | 1/2006 |
| GB | 480446 | 2/1938 |
| JP | 55-120353 | 2/1954 |
| JP | 2003-339478 | 12/2003 |
| JP | 2006-263295 | 10/2006 |
| WO | 90/14781 | 12/1990 |
| WO | 2006/114553 | 11/2006 |
| WO | 2015/112023 | 7/2015 |

* cited by examiner

Fig. 4
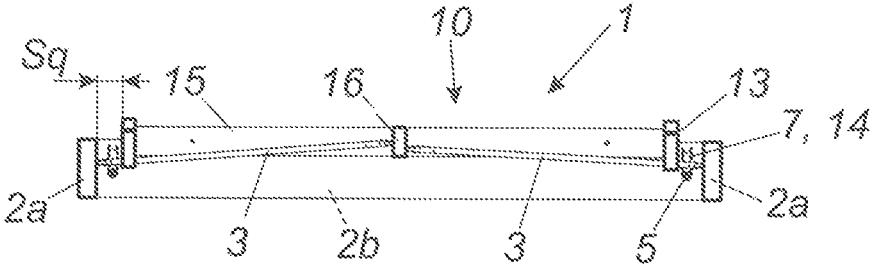
Fig. 5 Detail X
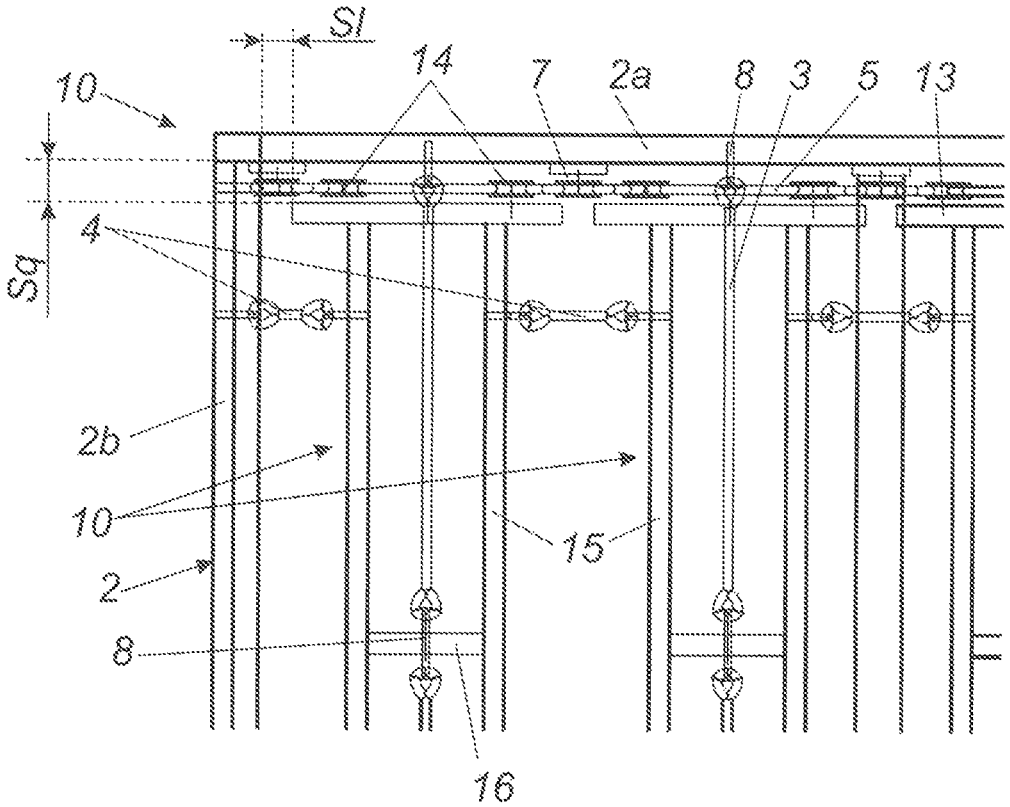
Fig. 6 Detail Y
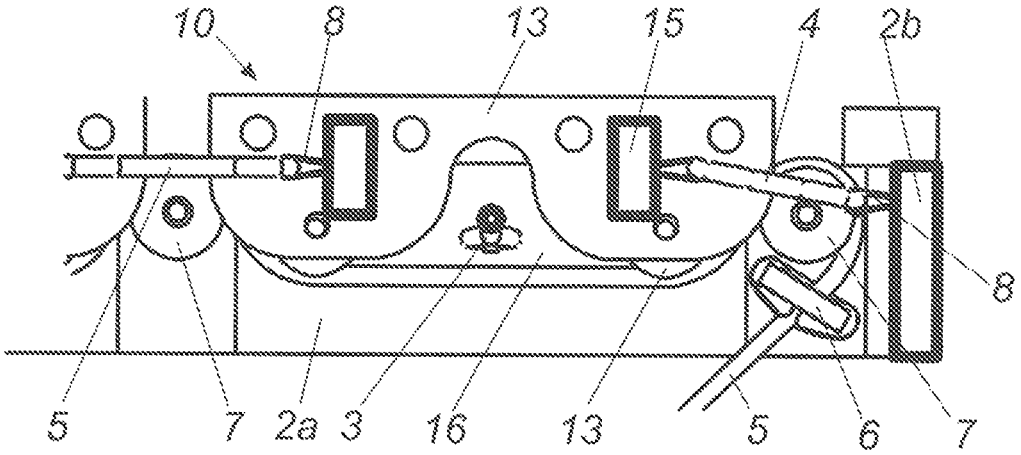

SLATTED GRATE

BACKGROUND OF THE INVENTION

The invention concerns a slatted frame for a reclining or seating furniture article, and a zone element for a slatted frame.

Slatted frames with zone elements arranged thereon, of the above-indicated kind, are known for example from EP 0923331 B1. However, they suffer from considerable disadvantages in regard to mounting of the individual zone elements. In the state of the art, mounting of the zone elements is effected by a mechanical connection between the frame and the zone elements. That is implemented, for example, by bars which can be moved in a corresponding opening along the longitudinal direction thereof, and thus enable a certain freedom of movement between the frame and the zone element. That freedom of movement is used for adaptation to the body of a user of the slatted frame. Nonetheless, the following disadvantages arise in the case of the slatted frame shown in the state of the art:

- The fact that the bars of the mechanical mounting are mounted moveably along the longitudinal axis thereof means that the freedom of movement of the zone elements is severely restricted. Thus the zone elements cannot rock or swing relative to the frame and additionally adapt to the body of the user. Dure to the linear movement of the bars only a movement of the zone elements in a vertical direction is possible.
- In addition friction occurs at the contact locations between the bar and the opening, and that can result in wear.
- Due to the friction between the opening and the bar noise can occur for the user of the slatted frame. Troublesome noises on a slatted frame are unacceptable to the user in many respects.
- In addition the superimposed movements between the zone element and the frame can give rise to stresses at the longitudinal guidance between the bar and the corresponding opening, and that can result in the zone element becoming blocked.

DE 29 902 965 U1 shows a support element which is either incorporated in a mattress or fixed to a bottom bed frame. The support element has rotary bearings for adaptation to the human body. Transverse slats are fixed in end cap elements. In the situation involving fixing to the bottom bed frame there is only inadequate flexibility for the user.

SUMMARY OF THE INVENTION

Therefore, the object of the invention is to provide a slatted frame which is improved over the state of the art, and a zone element which is improved over the state of the art.

If there is at least one elastic transverse bracing means (brace), wherein the zone elements are connected by way of at least one transverse bracing means to a longitudinal side of the frame, it is not necessary to use a complicated mechanical connection which is susceptible to failure and which also gives rise to noise between the zone elements and the frame. The use of the transverse bracing means and longitudinal bracing means means that it is possible for the zone elements to be mounted and braced moveably in the frame, whereby the zone elements are mounted in hanging relationship on or in the frame by the at least one elastic transverse bracing means and the at least one elastic longitudinal bracing means in spaced relationship with the frame and the mobility of the at least two zone elements is adjustable and can be limited by the carrier means. This design therefore does not involve an indirect contact between the zone elements and the frame. By virtue of the elastic transverse bracing means and the longitudinal bracing means sufficient freedom of movement for the zone elements is afforded to be able to adapt to the body of the user. If the zone elements are to be less flexible the carrier means is stressed more greatly. If further adjustment of the zone elements is to occur then the carrier means can be correspondingly less greatly stressed.

If at least two elastic longitudinal bracing means are arranged between each of the at least two zone elements, wherein the at least two zone elements connected together in that way are connected by at least two further longitudinal bracing means to the two opposite transverse sides of the frame, that affords a more stable suspension for the zone elements on the frame. The forces can be better distributed to a plurality of longitudinal bracing means and transverse bracing means. In that situation, the longitudinal bracing means are arranged in mutually spaced and parallel relationship along the longitudinal extent of the frame or in other words: parallel to the longitudinal sides of the frame. The transverse bracing means respectively brace the zone elements on both sides in the direction of the transverse extent.

If the longitudinal bracing means and the transverse bracing means are formed by encased rubber cables and/or spring elements which are connected to the frame and/or a zone element by way of at least one fixing means that affords flexible, stable and long-lasting bracing of the zone elements in the frame. The encasing around the rubber cables prevents damage to the rubber beneath it. In addition the encasing prevents the rubber stretching too far, in other words the encasing can also serve as an "end abutment" so that the zone elements cannot collide with the frame. It is also possible to provide a mix of spring elements, for example steel springs and rubber cables, on a slatted frame. The use either of rubber cables or spring elements is also possible. The transverse bracing and longitudinal bracing means are connected to the frame and/or the zone element by way of fixing elements—those fixing elements can be formed for example by screw eyes or other means. It would also be conceivable that the longitudinal bracing means and the transverse bracing means simply form at the ends thimbles or eyes which are directly or indirectly connected as fixing means to the zone element and/or the frame.

If each zone element is formed by at least two opposite carrier elements, wherein the carrier elements are connected together by a bar, that provides a light, compact and stable zone element. In addition, in the case of damage, for example to a carrier element or also a bar, replacement of the components is simple. It is not necessary to change the entire zone element. In addition it is possible, for example in relation to slatted frames of differing widths, to use the same carrier element and only to produce a suitably longer or shorter bar for adaptation to the width of the slatted frame.

If each zone element has at least one mounting element for receiving the at least one transverse bracing means and/or the at least one longitudinal bracing means then the engagement point or abutment point of the longitudinal and transverse bracing means can be implemented in defined fashion on the zone element. In that case the at least one mounting element can be arranged on the at least one bar. It is also possible for only the transverse bracing means to engage the mounting element, while the longitudinal bracing means are attached directly to the at least one bar and/or to the carrier element.

If each of the two zone elements has at least one, preferably elastic, connecting element for receiving the at least one slat that can achieve additional flexibility for the user. Not only is each of the individual zone elements mounted moveably in the frame, but also the slat disposed on the zone element. The slat itself is per se also flexible or resilient, which additionally enhances the comfort of the slatted frame.

If a transverse spacing and a longitudinal spacing can be produced between the at least two zone elements and the frame by the bracing of the at least two zone elements in the frame, whereby indirect contact between the frame and the at least two zone elements is prevented, noise production, tilting of the zone elements on a mechanical guide and wear are prevented. In addition the arrangement prevents the user when using the slatted frame from feeling uncomfortable and prevents hard abutment of the zone elements against the frame in an end position as the zone elements cannot make any contact with the frame by virtue of the spacings in relation thereto.

If the frame is formed by the two longitudinal sides which extend in parallel mutually opposite relationship along the longitudinal extent of the frame and are spaced from each other by two parallel mutually opposite transverse sides that produces an inexpensive and stable frame. It can additionally be even more reinforced by transverse strut means fitted between the two mutually parallel opposite transverse sides.

If a plurality of frame rolling bodies for receiving the at least one carrier means are arranged along the longitudinal side and along the longitudinal extent then mounting and adjustment of the zone elements can be implemented by way of the frame rolling bodies and the carrier means. In that arrangement the main mounting configuration can be afforded by the transverse and longitudinal bracing means. They define the position and location of the zone elements. The sink-in depth of the slatted frame and thus adaptability to the body of the user is adjusted by the carrier means. By virtue of the reduction in the tensioning at the carrier means a higher degree of flexibility is achieved at the zone elements whereby if necessary they can better adapt to the anatomical characteristics of the user. The carrier means acts so-to-speak as an additional mounting means and adjustment device for flexibility and adaptability of the zone elements on the slatted frame. It is preferably provided that at least one and preferably a respective zone element is arranged between two frame rolling bodies disposed on a longitudinal side. In the latter case a zone element is always arranged between two frame rolling bodies.

In an advantageous configuration of the invention at least one support rolling body for receiving the at least one carrier means is arranged on a longitudinal side, wherein the support rolling body is disposed in a region beneath the carrier element of a zone element between two zone rolling bodies. In that way, in the region in which a support rolling body is provided, that arrangement affords additional support for the respective zone element arranged thereabove, whereby a harder and more stable support for the user is afforded in that region of the slatted frame. Such support can be advantageous in particular in the region of the head, the shoulders and/or the loins. In that arrangement the support rolling body can be fixed on the longitudinal side of the frame.

If an adjusting element for adjusting the tension of the carrier means is arranged on the frame the user can then themselves adjust the flexibility and adaptability of the slatted frame. The adjusting element can be, for example, in the form of a coil, a cable clamp, an electric drive like for example a winch or also a linear motor. The adjusting element acts directly on the tension of the carrier means and thus on the flexibility and adaptability of the slatted frame and can be adjusted as desired by the user.

If the longitudinal bracing means and the transverse bracing means are of a resilient or elastic nature and the at least one carrier means is of a static configuration, preferably in the form of a static cable without elastic properties that affords a great degree of freedom for the zone elements by virtue of the elastic bracing means whereby that degree of freedom can be reduced by the static carrier means. The zone elements remain moveable under load by the user, but the mobility of the zone elements can be influenced by way of the static carrier means.

In a further aspect of the invention, a zone element is provided, and at least two zone rolling bodies are arranged for mounting the zone element on at least one carrier means along the longitudinal extent of each carrier element. Two contact points occur at each side of the zone element by virtue of the two zone rolling bodies. Excessive uncontrolled tipping of the zone element is prevented by virtue of those two contact support points. Accordingly, the zone element remains rotatable or tiltable about the transverse extent in an intended range, by virtue of the use of zone rolling bodies. As, however, they are spaced from each other, there is nonetheless a certain degree of inherent stability. There is no need to provide additional guidance, for example in the form of a bar or trunion, which engages into a corresponding counterpart portion. Stability is afforded by the at least two zone rolling bodies respectively disposed at each side, together with the longitudinal and transverse bracing means. The inherent stability is additionally enhanced by the carrier means.

If the at least two zone rolling bodies are arranged at the side of the carrier elements, that is remote from the bar, the spacing between the zone element and the frame can be increased. In addition, the contact with the frame rolling bodies disposed on the frame is simplified. Therefore, the zone rolling bodies and also the frame rolling bodies are in the same vertical plane and are connected together by the at least one carrier means.

If the at least two zone rolling bodies are respectively mounted at their own rotary axis parallel to a transverse extent of the zone rolling body, the two zone rolling bodies do not mutually influence each other. In addition, there is an axis spacing between the rotary axes of the at least two zone rolling bodies of at least 80 mm and at a maximum 220 mm, preferably at least 100 mm and at a maximum 200 mm, particularly preferably at least 120 mm and at a maximum 180 mm. The inherent stability of the zone element is enhanced by that spacing. If the rollers were to be closer together the zone elements would rather tend to tilt or sway.

The generation of noise in use of the slatted frame or zone element is also reduced by the at least two zone rolling bodies substantially comprising plastic rollers, wood rollers or metal rollers, wherein the rollers are mounted rotatably at at least one ball bearing. Direct mounting of rollers on a trunion could result in noise. In addition the ball bearings enhance the ease of operation in the movement of the zone elements and provide a maintenance-free system which for example does not have to be lubricated by lubricant or the like.

BRIEF DESCRIPTION OF THE DRAWINGS

Further details and advantages of the present invention are described more fully hereinafter by the specific description with reference to the drawings, in which:

FIG. 4 is a sectional view of the slatted frame, direction of view on the transverse side, FIG. 5 shows a detail from FIG. 2, FIG. 6 shows a detail from FIG. 3, FIGS. 7*a*-7*c* are diagrammatic views of the operating principle of the carrier means.

DETAILED DESCRIPTION OF THE INVENTION

Figure 1:
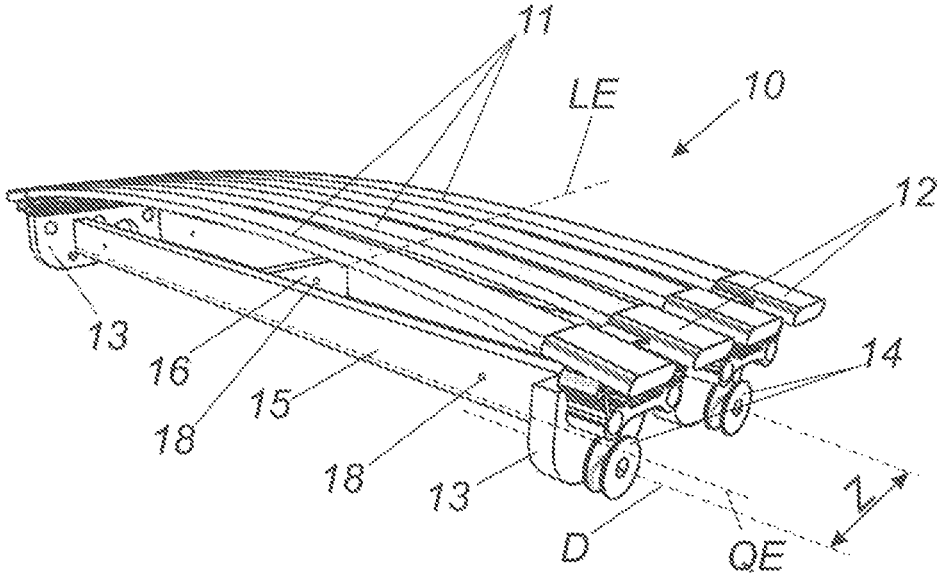
FIG. 1 is a perspective view of a zone element.

FIG. 1 shows a zone element 10 comprising two mutually opposite carrier elements 13 which are arranged parallel to each other, spaced by at least one bar 15. The bar 15 has a mounting element 16 for mounting the at least one transverse bracing means (i.e., transverse brace) 3 (not visible in FIG. 1) and is fixed at the fixing portion 18 on the mounting element 16. The bar 15 also has fixing portions 18, to which the at least one longitudinal bracing means (i.e., longitudinal brace) 4 can be attached. The connecting elements 12 are disposed on the carrier element 13. They connect the slats 11 to the zone element 10. The connecting elements 12 can be made from an elastic material to be able to promote the flexibility of the slats 11 and to make the slats 11 moveable relative to the rest of the zone element 10. The rotary axis D of the zone rolling bodies 14 is disposed parallel to the transverse axis QE which extends transversely relative to the longitudinal axis LE. The zone rolling bodies 14 are spaced from each other at a spacing Z.

Figure 2:
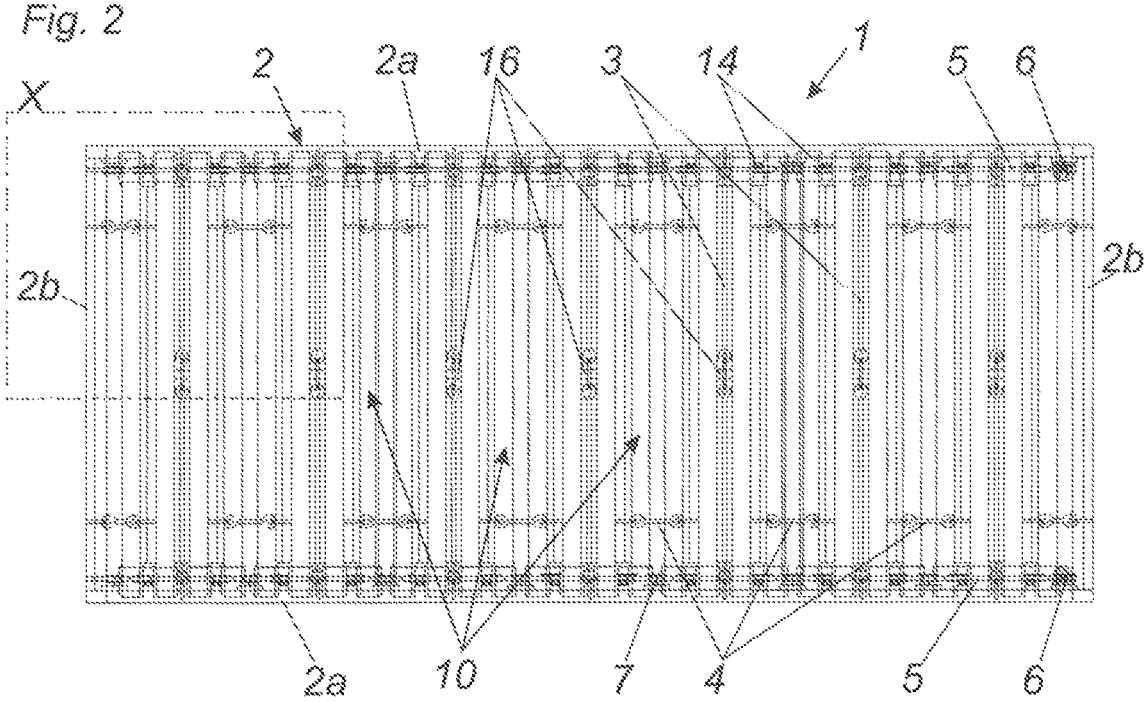
FIG. 2 is a plan view of a slatted frame.

FIG. 2 shows the slatted frame 1 with zone elements 10 arranged therein. The slatted frame 1 has a frame 2 comprising the longitudinal sides 2*a* and transverse sides 2*b*. It is also possible for additional reinforcing struts to be arranged between the opposite longitudinal sides 2*a* and the opposite transverse sides 2*b*. The zone elements 10 are connected together by way of the longitudinal bracing means 4. The first and also the last respective member in the chain of zone elements 10 is connected by way of further longitudinal bracing means 4 to the frame 2—more precisely to the transverse sides 2*b* of the frame 2. The carrier means (i.e., carrier) 5 extends parallel thereto on both sides. The transverse bracing means 3 are attached to the longitudinal sides 2*a* of the frame 2 and extend as far as the mounting elements 16 arranged at the zone elements 10. The detail X in FIG. 2 is described more fully in FIG. 5.

Figure 3:
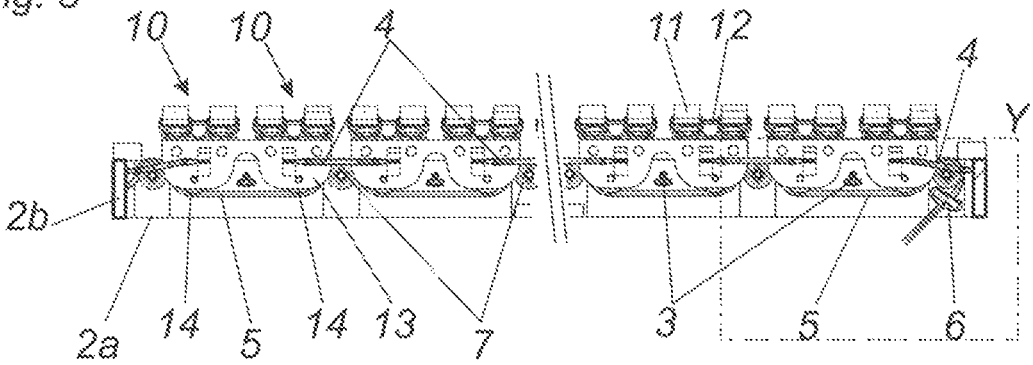
FIG. 3 is a side view of the slatted frame.

FIG. 3 shows a section through the longitudinal extent LE of the slatted frame 1 as a side view. The carrier means 5 extends from the transverse side 2*b* to the oppositely disposed further transverse side 2*b* on the other side of the slatted frame 1. There it is connected to an adjusting element 6. The tension at the carrier means 5 can be adjusted by a fixed connection of the carrier means 5 at one transverse side 2*b* and a moveable fixing or an adjustable fixing at the opposite transverse side 2*b*. In that case the carrier means 5 contacts the zone rolling bodies 14 and also the frame rolling bodies 7. A zone element 10 with at least two zone rolling bodies 14 is respectively disposed between two frame rolling bodies 7. In that case the connecting elements 12 with the slats 11 are arranged on the top side of the carrier elements 13. The detail Y in FIG. 3 is described more fully in FIG. 6.

FIG. 4 shows a sectional view looking on to the transverse side 2*b*. The zone elements are spaced at a spacing Sq from the longitudinal side 2*a* of the frame 2. That spacing is implemented by the use of transverse bracing means 3 which act towards both sides and which are operatively attached between the mounting element 16 and the longitudinal sides 2*a*. Disposed between the carrier element 13 and the longitudinal side 2*a* are the zone rolling bodies 14 and the frame rolling bodies 7 with the carrier means 5 which extends therebetween.

FIG. 5 shows the detail X from FIG. 2. It can be seen in that respect that the longitudinal spacing SL produced by the bracing effect is maintained by the longitudinal bracing means 4. In addition the transverse spacing SQ is maintained by the transverse bracing means 3. The sole contact between the frame 2 and the individual zone elements 10 is made by way of the carrier means 5 and the longitudinal bracing means 4 and transverse bracing means 3. In this arrangement the longitudinal and transverse bracing means 3, 4 are fixed by way of fixing elements 8 to the mounting element 16 and/or the bar 15 of the zone elements 10. They are also braced by way of fixing elements 8 to the frame 2. In this embodiment each zone element 10 has two bars 15. The mounting elements 16 connects the two bars 15.

FIG. 6 shows the detail Y from FIG. 3. The adjusting element 6, in this embodiment in the form of a cable clamp, is used for adjusting the tension at the carrier means 5. Therefore by pulling on the carrier means 5 it is possible to achieve a higher level of tension which remains maintained by the adjusting element 6. Instead of a cable clamp as illustrated it is also possible to use another adjusting element. For example rollers, threaded tensioners, linear motors, winches, cranks or also liquid-filled or gas-filled cylinders are suitable for that purpose. When pulling on the carrier means 5 the tension at the longitudinal bracing means 4 is also altered. They therefore generate a counteracting force against the tension of the carrier means 5 and prevent uncontrolled movements at the zone elements 10. Therefore the positioning of the individual zone elements 10 along the frame 2 or in the frame 2 is also maintained by the longitudinal and transverse bracing means 3, 4. In that arrangement however sufficient flexibility is afforded by the elastic transverse and longitudinal bracing means 3, 4 in order not to restrict the mobility of the zone elements 10 excessively. It would also be possible for example to use stronger or weaker transverse and longitudinal bracing means 3, 4 to be able to adapt the slatted frame 1 to heavier or lighter users. Accordingly it would also be advantageous if the transverse and longitudinal bracing means 3, 4 can be non-destructively replaced. It is thus possible also to implement a certain basic setting of the slatted frame 1 adapted to the bodyweight by way of the longitudinal and transverse bracing means 3, 4, with fine tuning being effected by way of the carrier means 5.

Figure 7A:
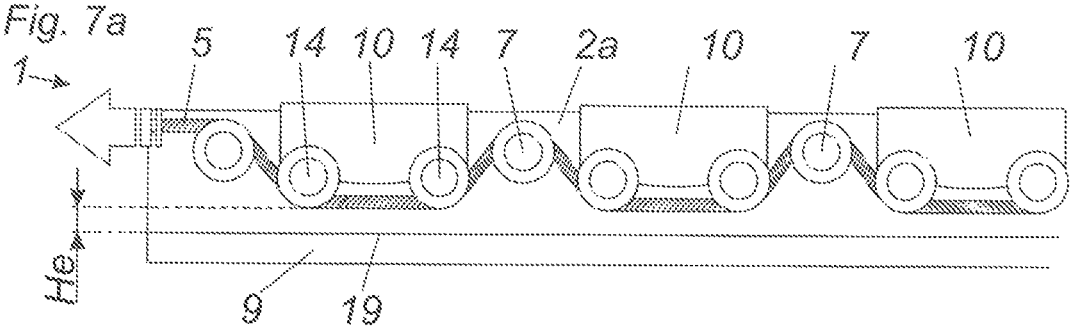
Figure 7B:
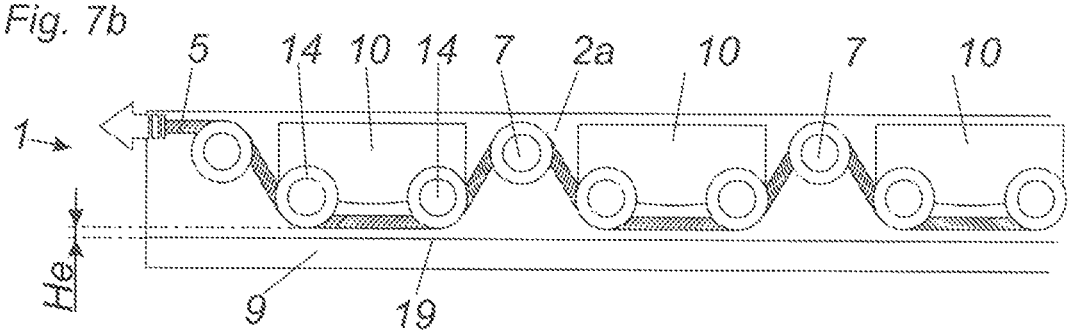
Figure 7C:
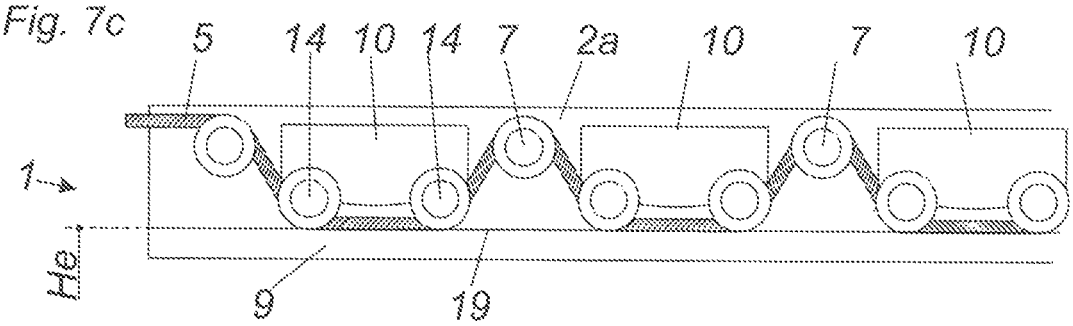

FIGS. 7*a*, 7*b* and 7*c* show the zone elements 10 at different heights relative to the longitudinal side 2*a* of the frame 2. It can be seen from FIG. 7*a* how the adjustment height HE of the zone elements 10 relative to a frame bottom edge 19 is higher than for example in FIG. 7*b*. Thus the tension at the carrier means 5 in FIG. 7*a* is selected to be higher than in FIG. 7*b*, which is reflected in the degree of freedom of the zone elements 10 and thus the flexibility and adaptability and softness of the slatted frame 1.

FIG. 7*c* shows how the tension of the carrier means 5 was reduced so greatly that the zone elements 10 have moved absolutely as far as the frame bottom edge 19. An abutment bar 9 could possibly be provided there, which allows the zone elements 10 to rest thereon. Adaptability and flexibility of the slatted frame 1 would therefore be deactivated by the carrier means 5, because of the lack of tension, no longer having any influence on the zone elements 10, and by the zone elements 10 resting unyieldingly on the abutment bar 9. In that case the adjustment height HE is equal to zero. In that way it is possible to provide for example that the user can be better supported. It would be conceivable, for example by way of pushing a button or another command, to completely lower all zone elements 10 in order to cause them to rest thereon. The user can thus get out of bed more easily by virtue of the lack of yieldingness of the zone elements 10. That is possibly highly advantageous precisely for infirm or older people.

In addition deactivation of adaptability is possibly to be viewed as being advantageous to acquire a reference value. The user can therefore feel for his desired adaptability of the slatted frame 1 in a stepwise procedure, starting from a zero value (no adaptability) to a maximum level of adaptability.

Figure 8:
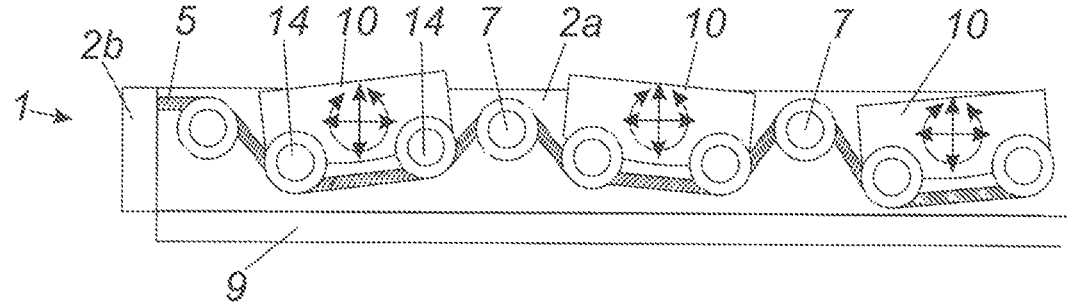
FIG. 8 is a diagrammatic view of the operating principle of the moveable zone element.

FIG. 8 diagrammatically shows the degrees of freedom of the individual zone elements 10. In this case they are mounted moveably along the longitudinal and transverse extent of the slatted frame 1 and can move with a tilting motion about the transverse extent. Even slight inclined movements in relation thereto are made possible by way of the flexible longitudinal and transverse bracing means 3, 4 which are not shown in FIG. 8. It can thus be the case that the individual zone elements 10 can be positioned relative to each other not only parallel but also slightly inclinedly. That inclined positioning is effected by way of the fact that the zone elements 10 are mounted at both sides by way of the zone rolling bodies 14. All those degrees of freedom are influenced by the tension in the carrier means 5. In addition the degrees of freedom are influenced by the basic setting which is to be attributed to the strength of the selected elastic transverse and longitudinal bracing means 3, 4. By virtue of a zone element for example in the region of the buttocks sinking down lower the next zone element, for example at the hips, can move upwardly, which leads to uniform support for the body of the user. That is effected by the connection of the individual zone elements by way of the carrier means.

Figure 9:
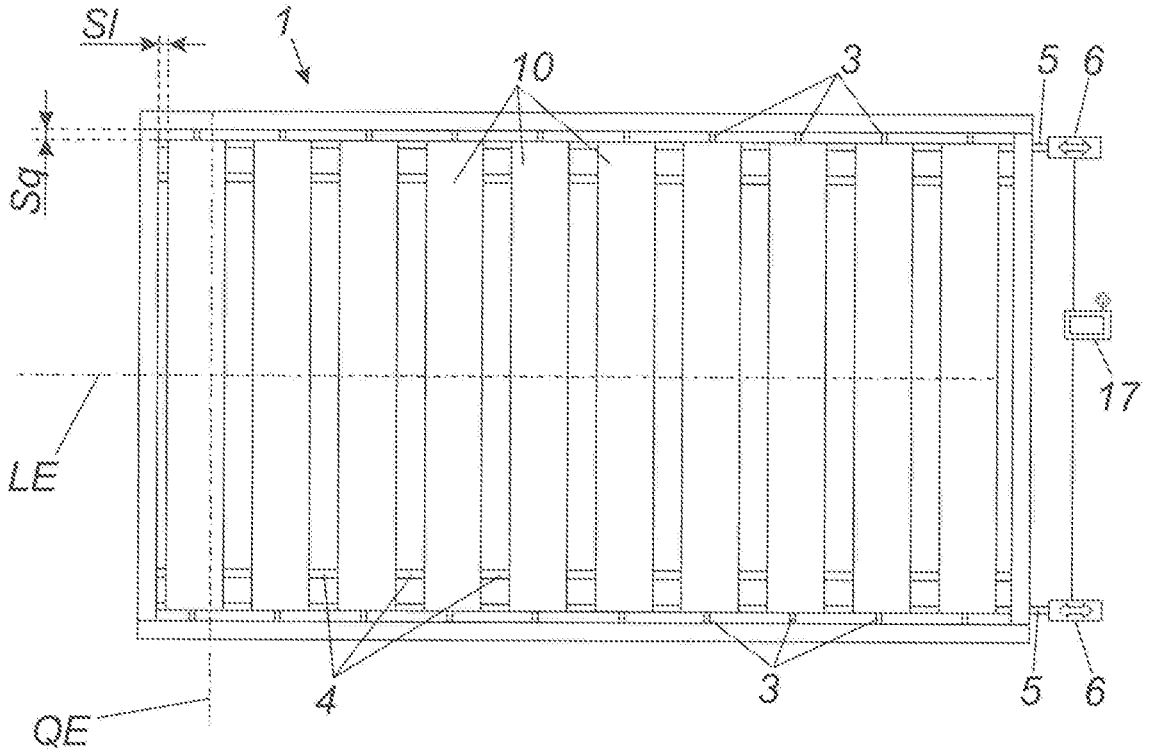
FIG. 9 is a diagrammatic view of the zone elements in the frame with spacings and adjusting element.

FIG. 9 diagrammatically shows the structure of the slatted frame 1 with the transverse spacing Sq, the longitudinal spacing SI, the longitudinal extent LE and the transverse extent QE. In addition it is possible to see the longitudinal and transverse bracing means 3 and 4. This embodiment has an electrically operated adjusting element 6 which can be open-loop and closed-loop controlled by way of a control element 17. In that way for example the desired tension at the carrier means 5 and thus the flexibility and adaptability of the slatted frame 1 can be adjusted simply by pushing a button on the control element 17. It is also possible for sensors to be arranged on the slatted frame, for example at the adjusting element 6, at the bracing means 3, 4 or directly at the carrier means 5, which ascertain the weight of the user, whereupon the flexibility and adaptability of the slatted frame 1 is adjusted automatically by way of detection of the data from the sensors and transmission thereof to the control element 17. The control element 17 can also be controlled indirectly for example by way of a remote control. Instead of a remote control there can also be a connection, for example a Bluetooth connection, to a smartphone or the like, which for example has a program, by way of which the desired parameters can be passed to the control element 17. That use could be advantageous for example in a hotel or also a hospital where many different people use the slatted frame and want to adjust it to their personal preferences. Setting of the slatted frame 1 or a plurality of slatted frames 2 could also be effected in centralised fashion by way of a computer or the like after the data of the person has been input.

Figure 10A:
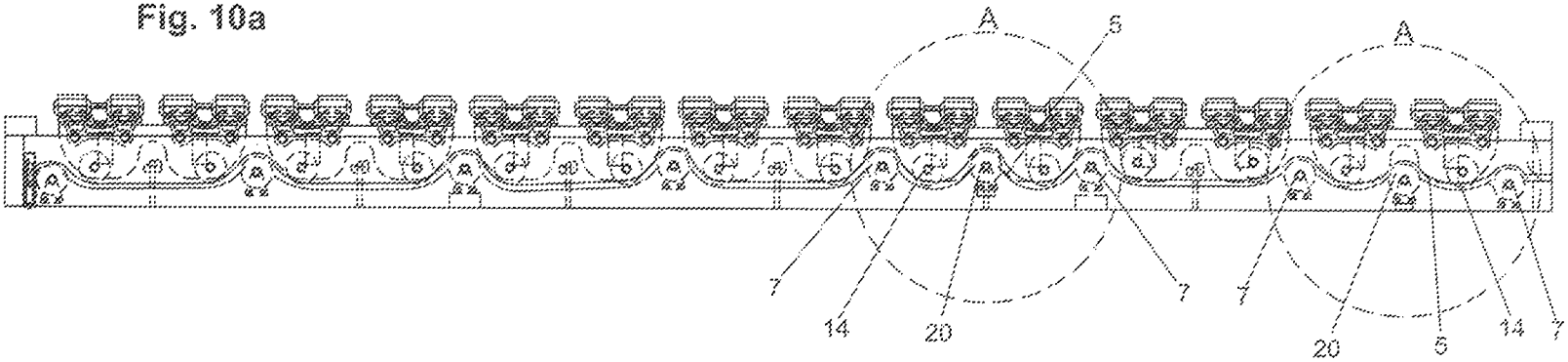
FIGS. 10*a*, 10*b* are detail views of a further embodiment of the slatted frame.
Figure 10B:
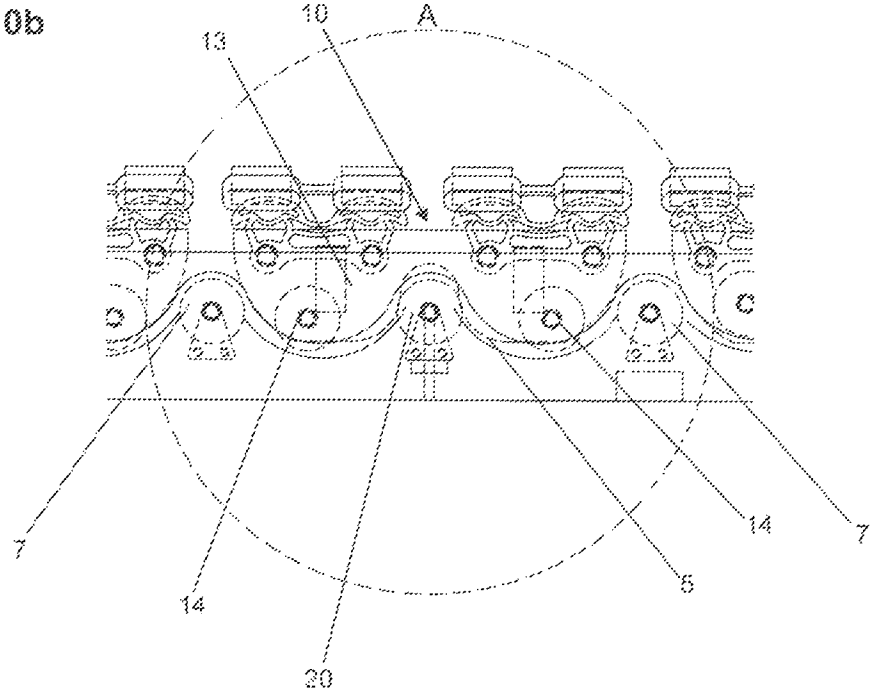

FIGS. 10*a* and 10*b* show an embodiment of the invention which is equipped with support rolling bodies 20, whereby it is possible to achieve additional support for relevant parts of the body. In this case the support rolling bodies 20 are arranged beneath a respective zone element 10 between two zone rolling bodies 14. In the embodiment of FIG. 10*a* it will be seen that, in those regions of the slatted frame in which the head and loin regions are arranged, a respective support rolling body 20 is arranged under the carrier element 13 of the zone element 10. That additional support provides that when loaded the zone elements 10 above the support rolling bodies 20 move downwardly to a lesser degree, thereby affording a harder and more stable support for the user in those regions.

FIG. 10*b* shows the detail A from FIG. 10*a*. It can be seen that a support rolling body 20 is provided in the region between two zone rolling bodies 14 under the carrier element 13. The support rolling bodies 20 are fixed to the longitudinal sides 2*a* of the frame. The carrier means 5 is guided above the support rolling body 20.

LIST OF REFERENCES

1 slatted frame
2 frame
2*a* longitudinal side
2*b* transverse side
3 transverse bracing means
4 longitudinal bracing means
5 carrier means
6 adjusting element
7 frame rolling body
8 fixing element
9 abutment bar
10 zone element
11 slat
12 connecting element
13 carrier element
14 zone rolling body
15 bar
16 mounting element
17 control element
18 fixing portion
19 frame bottom edge
20 support rolling body
Sq transverse spacing
SI longitudinal spacing
D rotary axis
Z axis spacing
He adjustment height

The invention claimed is:

1. A slatted frame for a reclining or seating furniture article, comprising:

a frame for receiving at least two zone elements, wherein a slat is arranged on the at least two zone elements, an elastic longitudinal brace, wherein the at least two zone elements by way of the longitudinal brace are connected together and/or are connected to a transverse side of the frame, a carrier fixed to the frame for mounting the at least two zone elements along a longitudinal extent of the frame, and an elastic transverse brace, wherein the at least two zone elements are connected to a longitudinal side of the frame by a transverse brace.

2. The slatted frame according to claim 1, wherein the elastic longitudinal brace is a first one of at least two first elastic longitudinal braces arranged between each of the at least two zone elements, wherein the at least two zone elements connected together in that way are connected by at least two second longitudinal braces to the two opposite transverse sides of the frame.

3. The slatted frame according to claim 1, wherein the elastic longitudinal brace and the elastic transverse brace are formed by encased rubber cables and/or spring elements connected to the frame and/or a zone element by a fixing element.

4. The slatted frame according to claim 1, wherein each zone element is formed by at least two mutually opposite carrier elements, wherein the carrier elements are connected together by a bar.

5. The slatted frame according to claim 1, wherein each zone element has a mounting element for receiving the elastic transverse brace and/or the elastic longitudinal brace.

6. The slatted frame according to claim 5, wherein the mounting element is arranged at the bar.

7. The slatted frame according to claim 1, wherein each of the at least two zone elements has an elastic connecting element for receiving the slat.

8. The slatted frame according to claim 1, wherein a transverse spacing and a longitudinal spacing are arranged between the at least two zone elements and the frame by bracing of the at least two zone elements in the frame, whereby indirect contact between the frame and the at least two zone elements is prevented.

9. The slatted frame according to claim 1, wherein the frame is formed by two longitudinal sides which extend in a parallel mutually opposite relationship along the longitudinal extent of the frame and are spaced from each other by two parallel mutually opposite transverse sides.

10. The slatted frame according to claim 9, further comprising a plurality of frame rolling bodies for receiving the carrier arranged along at least one of the two longitudinal sides.

11. The slatted frame according to claim 10, wherein at least one of the at least two zone elements is arranged between two of the plurality of frame rolling bodies along one of the two longitudinal sides.

12. The slatted frame according to claim 11, wherein a respective one of the at least two zone elements is arranged between two of the plurality of frame rolling bodies along the one of the two longitudinal sides.

13. The slatted frame according to claim 11, further comprising a plurality of support rolling bodies arranged along the one of the two longitudinal sides, wherein the plurality of support rolling bodies are arranged in a region below a carrier element of at least one of the at least two zone elements.

14. The slatted frame according to claim 1, further comprising an adjusting element on the frame for adjusting the tension of the carrier.

15. The slatted frame according to claim 1, wherein the elastic longitudinal brace and the elastic transverse brace have a resilient or elastic nature, and the carrier has a static configuration of a static cable without elastic properties.

16. A zone element for the slatted frame according to claim 1, the zone element including:

at least two mutually opposite carrier elements oriented in mutually parallel relationship and having a longitudinal extent, and a bar by which the carrier elements are connected together transversely relative to the longitudinal extent, wherein at least two zone rolling bodies are arranged for mounting the zone element on a carrier along the longitudinal extent of each of the at least two carrier elements.

17. The zone element according to claim 16, wherein the at least two zone rolling bodies are arranged at a side of the at least two carrier elements remote from the bar.

18. The zone element according to claim 16, wherein the at least two zone rolling bodies are respectively mounted at their own rotary axis parallel to a transverse extent of a respective one of the at least two zone rolling bodies.

19. The zone element according to claim 18, wherein the a spacing between respective rotary axes of the at least two zone rolling bodies is at least 120 mm and at a maximum 180 mm.

20. The zone element according to claim 16, wherein the at least two zone rolling bodies substantially comprise plastic rollers, wood rollers, or metal rollers rotatably mounted at a ball bearing.

* * * * *